US006042087A

United States Patent [19]

Heinemann

[11] Patent Number: 6,042,087

[45] Date of Patent: Mar. 28, 2000

[54] DEVICE FOR EQUALIZING WEIGHT OF A HANGING LOAD

[75] Inventor: Albert Heinemann, Ehrenkirchen-Scherzingen, Germany

[73] Assignee: Theodor Kromer GmbH, Unternehmensgruppe Unican, Umkirch, Germany

[21] Appl. No.: 09/027,030

[22] Filed: Feb. 20, 1998

[30] Foreign Application Priority Data

Mar. 15, 1997 [DE] Germany ..... 297 04 761
Sep. 4, 1997 [EP] European Pat. Off. ..... 97 115 314

[51] Int. Cl.[7] ..... B66D 1/14

[52] U.S. Cl. ..... 254/364; 254/277; 254/278; 254/383

[58] Field of Search ..... 254/364, 269, 254/270, 277, 278, 374, 375, 380, 383, 391, 392, 406, 411, 412, 417

[56] References Cited

U.S. PATENT DOCUMENTS

| | | | |
|---|---|---|---|
| 929,508 | 7/1909 | Smith | 254/374 X |
| 1,014,728 | 1/1912 | Tabulo | 254/391 X |
| 1,369,147 | 2/1921 | Valls | 254/269 X |
| 2,284,532 | 5/1942 | Napier | 254/380 X |
| 2,913,224 | 11/1959 | Uhlig | 254/380 X |
| 2,939,680 | 6/1960 | Powell | 254/374 X |
| 4,042,213 | 8/1977 | Schreyer et al. | 254/270 |
| 4,083,510 | 4/1978 | Gomez . | |
| 5,263,660 | 11/1993 | Brozik | 254/269 |
| 5,615,865 | 4/1997 | Fountain | 254/269 |
| 5,863,029 | 1/1999 | Fanger et al. | 254/278 X |

FOREIGN PATENT DOCUMENTS

| | | | |
|---|---|---|---|
| 2 261 172 | 9/1975 | France . | |
| 2 521 541 | 8/1983 | France . | |
| 2036 192 | 2/1971 | Germany . | |
| 1 481 875 | 5/1972 | Germany . | |
| 26 19 216 A1 | 11/1976 | Germany . | |
| 28 44 187 A1 | 4/1980 | Germany . | |
| 25 59 300 C2 | 8/1984 | Germany . | |
| 39 33 505 A1 | 4/1990 | Germany . | |
| 34 11 959 C2 | 9/1993 | Germany . | |
| 295 19 208 U1 | 3/1996 | Germany . | |
| 196 23 265 A1 | 1/1997 | Germany . | |
| 412133 | 10/1974 | U.S.S.R. | 254/278 |

*Primary Examiner*—Donald P. Walsh
*Assistant Examiner*—Emmanuel M. Marcelo
*Attorney, Agent, or Firm*—Akin, Gump, Strauss, Hauer & Feld, L.L.P.

[57] ABSTRACT

A device (1) for equalizing the weight of a suspended load, for example a tool to be operated by hand, includes a cable drum (2) and at least two parallel or substantially parallel suspension cables (3), which can be evenly wound up and unwound on a corresponding number of grooves (9) of matching diameter arranged parallel alongside one another on the cable drum (2). Each of the suspension cables (3) has for this purpose a resistance to tear corresponding to or exceeding the nominal load to be accommodated, so that considerably larger safety reserves are present, and even if one cable tears, the remaining cable can continue to carry the load. By distributing the load on two cables, the danger of a cable tear is, however, at the same time diminished.

20 Claims, 3 Drawing Sheets

DEVICE FOR EQUALIZING WEIGHT OF A HANGING LOAD

BACKGROUND OF THE INVENTION

The invention concerns a device for equalizing the weight of a hanging load, especially a tool to be operated by hand, for example welding tongs, in the form of a weight equalizer or spring tension, wherein the device has a cable drum and a suspension cable which can be unwound from it against the force of a spring serving as weight equalizer, as well as a housing in which the cable drum is rotatably mounted and which has an opening for the suspension cable which emerges tangentially downward from the cable drum, wherein the cable drum in particular has an increasing diameter from the end of the suspension cable roll up to the end of the cable portion to be unwound last when letting the suspension cable down.

Such a weight equalizing device is known, for example, from DE-25 59 300 C2, and has proven itself. Here, however, there exists the problem that the suspension cable must be examined after a certain time as to whether it still has complete carrying capacity to satisfy safety standards, or whether it shows damage, which makes a replacement necessary. Such an examination is often neglected or is too inexact as an examination by appearance only.

For this reason, it is also possible to replace the suspension cable after a specified time regardless of whether it is really necessary or not, which above all then means an unnecessary expenditure because the suspension cable is essentially still in order.

If one wishes to use such a suspension cable for the longest time possible, safety measures must be taken in order to avoid sudden tearing with a corresponding danger of accident. For example, it is known to provide the coupling device, located at the end of the cable for hanging a load or a tool, with an arrester cable which at all times follows the suspension cable by means of its own winding device, and which in the event the suspension cable breaks can catch and pick up the load by means of a centrifugal clutch. This represents a relatively expensive device with which, in addition, the problem exists that the arrester cable is likewise subjected to a wear and tear owing to its constant motion, and consequently must be subjected to checking again and again.

SUMMARY OF THE INVENTION

For this reason, there exists the object of creating a device of the type mentioned at the beginning, in which the special arrangement of an arrester cable with its own winding device can be avoided, despite which, however, an arbitrary changing of the suspension cable or an insufficient examination can be omitted, and the suspension cable nonetheless need only be replaced in the event of breaking.

The surprising solution for this apparently contradictory objective consists in that at least two parallel or substantially parallel suspension cables are provided, and the cable drum has a number of grooves, respectively arranged alongside one another and respectively matching the diameter and corresponding to the number of suspension cables, for accommodating these suspension cables, wherein the grooves running helically on the cable drum are arranged respectively parallel to one another from their beginning to the end, and that each of the suspension cables has a breaking resistance corresponding or exceeding the nominal burden to be accommodated.

In this way, there thus results a device for equalizing weight with which the respectively desired weights or tools can be attached without concern until one of the cables tears or breaks. The second cable is then in a position, with respect to its carrying capacity and taking into account the respective the usual safety reserves, to carry the suspended load alone. The user nonetheless receives the signal from the occurring cable break, that the suspension cable or the entire device must be replaced.

In the event that the user should disregard a clear signal of this type, because he is of the view that indeed one suspension cable can still carry the load, he is nonetheless forced into an exchange, because the torn cable can no longer be wound up and above all can no longer be unwound when the cable drum is activated, because a tension force is missing on its free end, so that this torn cable jams up at the latest with an unwinding operation following a perhaps still functioning winding up operation, owing to the diameter enlargement between cable drum and housing associated with this, and disturbs the operation of the device or even shuts the device down.

Advantageously, safety is considerably increased owing to the arrangement of the invention of at least two parallel wound up suspension cables which can be wound off, because each suspension cable is in a position to carry the respective load alone, especially when considering the usual safety reserves, so that such a device can and may be operated overhead.

An especially appropriate configuration of the invention, which above all makes possible the most even distribution of the burden on the several, especially two, suspension cables and at the same time contributes to taking into account the changing effective radius on the cable drum during increasing unwinding of the suspension cable from the conical cable drum, can consist in that, beneath the opening provided on the housing for the suspension cable a cable guide is arranged with guide openings, especially separated from one another, for the individual suspension cables, which is fastened to a pendulum which preferably can be pivoted around the rotation axis of the cable drum. If the effective drum diameter increases during increasing lowering of the suspension cable, the suspension cables wander more and more from the center axis of the cable drum viewed from outside. The cable guide can follow the increase without difficulty owing to its attachment to the pendulum. The cable guide itself has here the considerable advantage that it excludes a mutual entanglement of the suspension cables, which is possible without such a cable guide, and which would demand a considerable adroitness from the user for a tool suspended on it.

The pendulum carrying the cable guide can consist of two arms, which are hinged at a distance from each other on the same axis, especially on the axis of the cable drum, preferably on the overhanging ends of the axis of the cable drum opposed to each other. The cable guide can have two spaced attachment points for these two arms, between which the guide openings for the suspension cables are arranged. In this connection, it is beneficial if the two arms of the pendulum are attached on the end faces of the cable guide, which is thus situated between the two arms. This yields overall a stable suspension of the cable guide, which can well absorb or transfer the lateral forces to be expected.

In order to keep the wear and tear of the cable guide as small as possible in the area of its guide openings, the rope guide can for its part be rotatably or pivotably or mounted on the pendulum or on the pendulum arms to compensate for the pendulum movements. The deflection of the pendulum in relation to a vertical position can then be largely compensated by a corresponding counter rotation of the cable guide.

A further expedient configuration of the invention can consist in that the cable guide or at least a part of the cable guide having guide openings for the suspension cables is made of a wearing material and is exchangeable. For example, sleeves inserted into the guide openings which can easily be removed and replaced when they are very worn would be conceivable. The suspension cables themselves are thereby spared, for the wear and tear is to a certain extent shifted from the suspension cables to the cable guide. At the same time, the wear of the cable guide can even be optically checked, thus very easily, while the wear of the suspension cable is more difficult to recognize.

The cable guide can have a number of respectively spaced guide openings for the individual suspension cables corresponding to the number of suspension cables, whose spacing can be equal or somewhat larger than the spacing between the grooves of the cable drum, and consequently between the suspension cables on the cable drum. It can thereby be achieved that the suspension cables are well guided back to the parallel grooves respectively receiving them when winding up, so that the next unwinding operation can take place undisturbed. Nevertheless, the user receives a defined end of all suspension cables for mounting a suspension device.

Cable joints with holes or boring holes or cable slings (which are respectively formed by the suspension cables) running transversely can be provided respectively on the free ends of the suspension cables to be unwound from the cable drum. These holes or borings or slings accommodate a common bearing bolt or pin, rotatable in relation to the cable joints, to which a coupling element with load-bearing body, for example a suspension eye or for attaching a suspension eye or a suspension hook or the like, can be attached. Thus, an even distribution of the load to be suspended on both suspension cables can be attained through the cable joints and bearing pin or bolt.

Here, it is especially beneficial if the coupling element connected with the bearing pin or bearing bolt is constructed with a fork-shape and is connected with the bearing pin or bearing bolt on both sides of the cable joints, especially rotatably and preferably separably. Should the two suspension cables have differences in length owing to manufacture or to stress in the course of time, this can automatically be compensated for by a corresponding tilting of the bolt.

An especially advantageous further configuration of the invention can consist in that the coupling element engages with a bearing projection between the engagement positions of the two suspension cables on the bearing bolt, and the bearing bolt in particular projects on both sides in relation to this coupling element, and is particularly essentially freely rotatable about an axis, running horizontal, transverse or at right angles to the bearing bolt in the operating position. It can thereby be achieved that, in the event of suspension cables of various lengths or cable joints or slings positioned at various heights on the suspension cables, the bearing bolt automatically adapts itself to such different height positions by swinging into a tilted position, and despite these various height positions distributes the force from a load-bearing element, for example a suspension eye or a hook, largely evenly on both suspension cables. Consequently, it is not necessary to adjust the ends of the suspension cables with high precision to a matching height level. Rather, minor deviations in this regard can be automatically compensated for by a corresponding swivelling in a very simple manner.

It is especially expedient for this purpose if the coupling element and the bolt are connected to each other by means of a ball joint head, wherein the ball joint head has a boring or aperture for the passage of the bolt, and engages with its ball surface on a negative ball surface inside the coupling element in a pivotable or perhaps even rotatable manner. Equalizing different height levels of the ends of the suspension cables can consequently take place with simple motions in the connection between bearing bolt and coupling element, so that load-bearing elements engaging on the bearing bolt need not for their part contain appropriate joints or swivelling possibilities.

A further very advantageous configuration of the invention can consist in that the load-bearing element is rotatably mounted about a vertical axis on the coupling element. It is above all expedient for this purpose if the coupling element carries the load-bearing element, for example a load-bearing fork or bell, below the bearing bolt, which load-bearing element is rotatably connected with the coupling element around a vertical axis, and on which a suspension eye, a load hook or the like is attached, or which is itself a suspension eye, a load hook or the like.

Owing to this rotatability of the load-bearing element, and consequently of the suspension eye or suspension hook, relative to the coupling element, the suspended load can be rotated at will, without the two suspension cables being able to become entangled with each other. In addition, there thereby results the possibility of suspending the housing of the device in any desired way, thus even rotatably, without there existing the danger of the two suspension cables becoming entangled with each other through any rotation motion made possible in this way.

For limiting the winding up motion of the suspension cable on the cable drum, one of the suspension cables can carry a cable clip as a stop for the uppermost position, especially in relation to the cable guide, while the further suspension cable or cables can remain without such a cable clip. This is possible because the suspension cables are wound up simultaneously and parallel, and the stop of one suspension cable prevents further rotation of the cable drum. It is also advantageously avoided that the further suspension cable or cables need to be provided with a part restricting their lifetime, namely a cable clip.

Here, it can be expedient if a buffer is arranged between the cable guide and the cable clip. The buffer absorbs or cushions the impingement of the cable clip on the cable guide. This buffer can be penetrated at least by the suspension cable having the cable clip, preferably by all suspension cables, and especially be movable up and down with the cable clip and the suspension cable. Consequently, this buffer practically becomes a component of the stop formed by the cable clip and does not cause any friction on the suspension cables, which would occur if the buffer were a component of the cable guide.

Altogether, a device for equalizing the weight of suspended loads with high user safety results, so that it is even possible to work therewith overhead. Should a suspension cable be worn to such an extent that it tears, the load nonetheless cannot fall down, because the additional suspension cable or cables will continue to hold it. Nonetheless, it becomes clear for the user that the suspension cable or the entire device must be exchanged. Consequently, with increased safety constant inspections can be avoided. Despite this, working with this device is not uncomfortable because precautions against a twisting of the several suspension cables with each other can be avoided.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings in partially schematic representation.

DETAILED DESCRIPTION OF THE INVENTION

Figure 1:
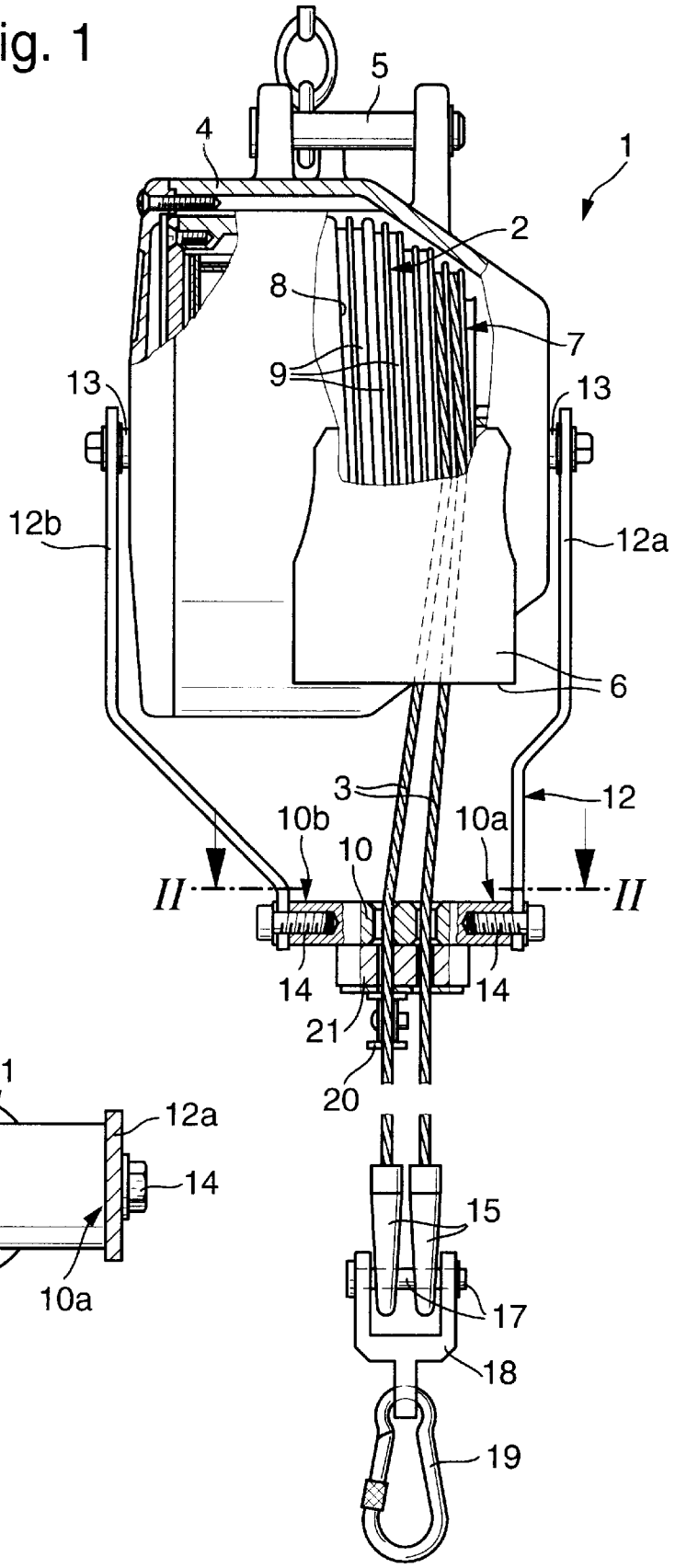
FIG. 1 is a side view, partially in section, of a device of the invention for weight equalization with two suspension cables, arranged parallel to each other on a conical cable drum and lowerable by rotating the drum, which run below an opening through the housing of the cable drum and through a swinging suspension cable guide.

A device for equalizing the weight of a hanging load, thus a so-called "weight equalizer," designated as a whole as I which here has the for of a spring tension, has a cable drum 2 and two suspension cables 3 which can be unwound from the drum against the force of a spring (not shown in greater detail in the drawings) serving as weight equalizer, as well as a housing 4 in which the cable drum 2 is rotatably mounted.

In its upper region the device 1 has an overhead suspension 5 on its housing 4, with which it can, for example, be positioned in a required position at a work place. The weight to be equalized can be the weight of a tool, for example that of welding tongs, which can be suspended on the lower end of the suspension cable 3 in a manner yet to be described.

Figure 3:
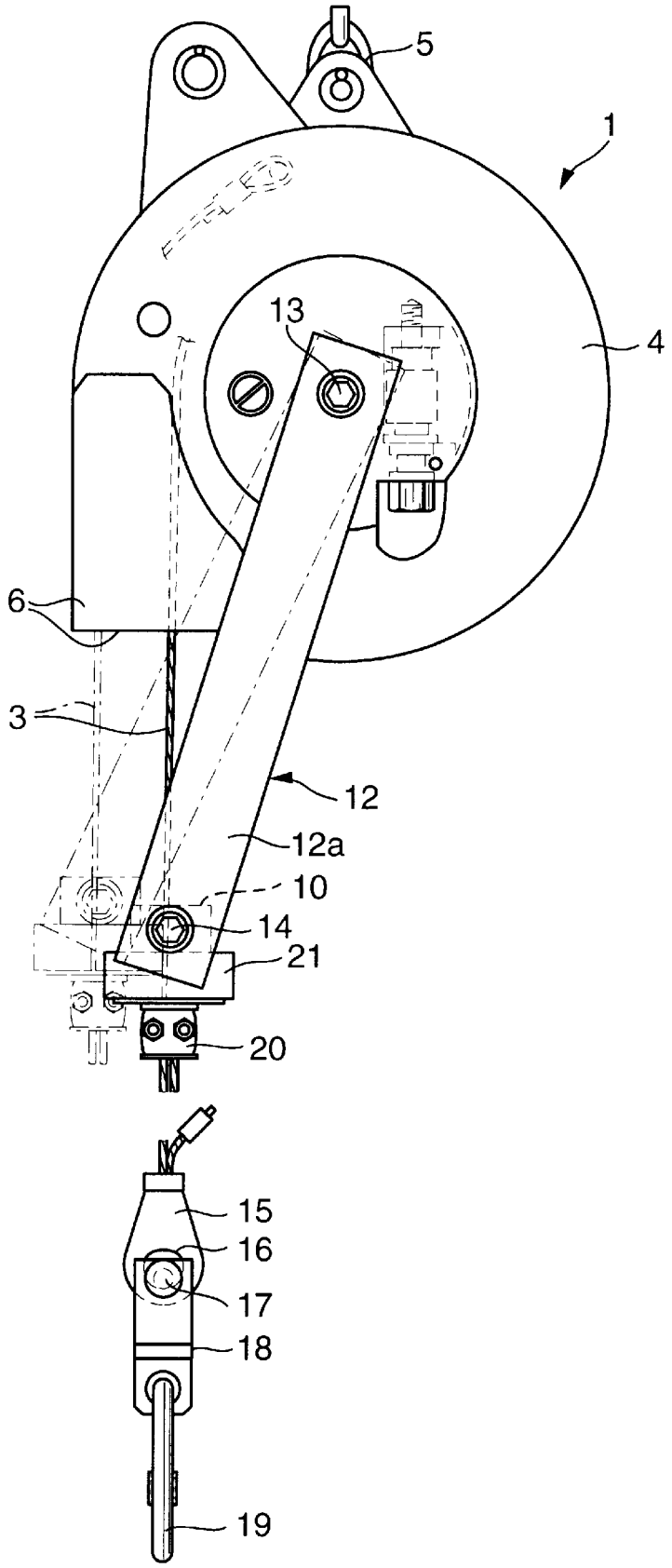
FIG. 3 is a side view of the device according to FIG. 1.

In the lower region, approximately tangential to the housing 4 and to the cable drum 2, the housing has an opening 6 for the suspension cable 3 exiting downwardly, which for this purpose has dimensions which take into consideration that the cable drum 2 has an increasing diameter from the end of the suspension cable rollup 7 up to the end 8 of the cable part last unwound in lowering the suspension cable 3. Primarily in FIG. 1, one clearly recognizes the conical form of the cable drum 2 resulting from this. At the same time, it thereby becomes clear that the opening 6 requires, as well as in the axial direction, a sufficiently large dimension for unwinding, because the exiting suspension cables 3, following the shape of the cable drum 2, upon unwinding progress out more and more from the end of the suspension cable windup 7 to end 8, whereby they at the same time arrive at an ever greater diameter, so that even in the transverse direction a sufficient dimensions of the opening 6 is necessary, which is indicated in FIG. 3.

As already mentioned, in the embodiment are provided two suspension cables 3, essentially parallel in the area of the opening, and the cable drum 2 has a number of helix-shaped grooves 9 arranged parallel alongside one another, corresponding to the number of the suspension cables 3 of respectively matching diameter for taking up these suspensions cables 3. The grooves 9 running helically on the cable drum 2 are arranged respectively parallel to one another from their beginning, thus from the end of the suspension cable roll up 7 to the end 8, so that both suspension cables 3 can be wound up and unwound at the same time, with equal length and synchronously. Each of suspension cables 3 has a wear resistance corresponding approximately to the nominal load to be assumed or exceeding this by a safety factor. That is, each suspension cable alone can also carry the load to be assumed. It is thereby possible to use the suspension cables 3 until one of them is clearly visibly worn or even tears, without there existing a danger for the user. Expensive checks can thus be dispensed with to a great extent.

Figure 2:
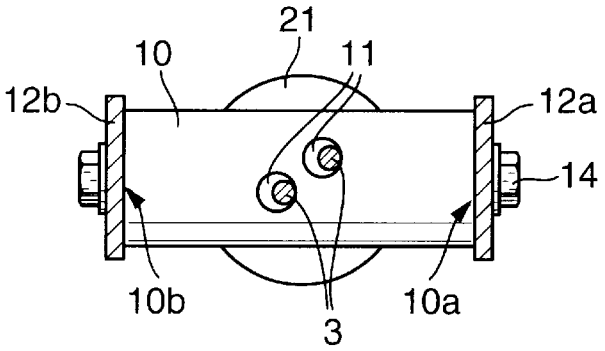
FIG. 2 is a cross section through the suspension of the cable guide with plan view of this cable guide in accordance with section line II—II in FIG. 1.

Beneath the opening 6 on the housing 4, a cable guide designated as a whole with 10 is arranged, which in accordance with FIG. 2 has guide openings 11 separated from each other for the individual suspension cables 3. This cable guide 10 is attached to a pendulum 12 in accordance with FIGS. 1 and 3, whose various swivel or pendulum positions are represented in FIG. 3. The initial position with raised suspension cables 3 is represented with continuous lines, thus the arrangement also recognizable in FIG. 1, while dash-dot lines designate a lowered position, in which the suspension cables 3 are lowered and consequently go off tangentially downward from an area of larger diameter of the cable drum 2. The cable guide 10 can therefore take into account in a simple manner the increasing roll diameter of the cable drum 2, when the suspension cable 3 is lowered, and prevent a mutual twisting and entanglement of the suspension cables 3 in a simple and nonetheless effective manner in all intermediate positions as well as primarily in the unwound end position.

The pendulum 12 carrying the cable guide 10 consists of two arms 12*a* and 12*b* in the embodiment accordance with FIG. 1, which are pivotably linked at a distance to each other on the same axis (in the embodiment, axis 13 of the cable drum 2) at opposite ends of this axis 13 from each other and outside the housing 4. The cable guide 10, for its part, has two spaced attachment sites 10*a* and 10*b* for these two arms 12*a* and 12*b*, between which the guide openings 11 for the suspension cables 3 are arranged. In this connection, it is provided in the embodiment that the two arms 12*a* and 12*b* of the pendulum 12 are attached on the end faces of the cable guide 10, thus accommodating this between them, so that a simple attachment is possible with attachment screws 14 operating from the end of the cable guide 10. If need be, the cable guide 10 can be rotatably or pivotably attached or mounted at this point for equalizing the pendulum motions for their part on the pendulum 12 or the pendulum arms 12*a* and 12*b*.

It should still be mentioned that in an equivalent manner the cable guide 10 could also be displaceably mounted in a suitable manner transverse to the axis 13 of the cable drum 2, instead of being pivoted by means of a pendulum, in order to be able to follow the change of position of the suspension cables 3 while unwinding.

It is well recognizable in FIG. 1 that the cable guide 10 can easily be replaced, in that the attachment screws 14 can be loosened. Consequently, the cable guide 10 or at least a part of the cable guide 10 having the guide openings 11 can consist of material capable of wearing and be exchangeable. In this manner, the cables 3 are protected against a friction-based wear relative to the cable guide 10.

The cable guide has a number of guide openings 11 for the individual suspension cables 3 respectively spaced from each other, corresponding to the number of suspension cables 3. That means that in the embodiment two such guide openings 11 which are separated from each other are provided, the distance of which is equal to or somewhat larger than the distance between the grooves 9 of the cable drum 2 and thus of the suspension cables 3 on the cable drum 2. The cable guide 10 thus not only has the object of preventing the suspension cables 3 from a mutual entanglement, but can also bring these to a slightly larger distance from one another, in order to bring about a simpler attachment of the load or the cable joints necessary for this.

One recognizes clearly primarily in FIG. 1 that cable joints 15 with holes 16 (FIG. 3) or borings running in the transverse direction are provided on the respective free ends of the suspension cables 3 to be unwound from the cable drum 2. These cable joints 15 accommodate a common bearing pin or bearing bolt 17, which can in particular be rotated in relation to the cable joints 15, and to which a coupling element 18 with suspension eye (or for attaching a suspension eye 19) or a suspension hook or the like is attached. For this purpose, this coupling element 18 is constructed with a fork-shape, and is connected especially rotatably and preferably separably with the bearing pin or bearing bolt 17 on both sides of the cable joints. It becomes clear mainly on the basis of FIG. 1 that when hanging a load on the suspension eye 19, thus through the coupling element 18, the force can be transferred evenly to the suspension cables 3, even if these are of slightly different length, be it due to their manufacture or due to somewhat different strains in their loading, because then the bearing bolt 17 can automatically tilt in relation to the horizontal position recognizable in FIG. 1.

The apparent increased expenditure of providing two suspension cables 3 is thus more than made up for, because these are at all times correspondingly subjected to less stress and thereby have a longer lifetime. Above all, the burdensome or expensive checkups can largely be dispensed with, since even one suspension cable 3 alone could bear the load to be assumed. Thus, in the event of a break of one of the suspension cables 3, the load is always still held. The break or the clearly visible wear of one of the suspension cables 3 can thus suffice as the inspection. Should one of the suspension cables 3 tear, the user is practically forced to replace the suspension cables 3 or the device 1, because the suspension cable 3 which is no longer standing under tensile stress will already lead to a jamming between cable drum 2 and housing 4 in its interior, either upon being wound up or at the latest during the next unwinding operation, because such an unstressed suspension cable 3 is no longer drawn into the groove 9.

One furthermore recognizes in FIGS. 1 and 3 that for limiting the winding up motion of the suspension cable 3 on the cable drum 2, only one of the suspension cables 3 carries a cable clip 20 as a stop for the uppermost position, especially in relation to the cable guide 10. This suffices to stop the winding up motion of the cable drum 2 brought about by a spring, because both suspension cables 3 are wound up at the same time. Consequently, one of the suspension cables 3 remains free from a cable clip 20 of this type, which on the one hand must be installed, and which on the other hand subjects the point of attachment of this suspension cable 3 to stress.

One clearly recognizes in FIGS. 1 and 3 that between the cable guide 10 and the cable clip 20, a buffer 21 is arranged, so that the cable clip 20 does not impinge directly on the cable guide 10. Rather, such an impinging movement is absorbed or cushioned by the buffer 21.

In this connection, chiefly FIGS. 1 and 2 make it clear that the buffer 21 is penetrated not only by the suspension cable having the cable clip 20, but by both suspension cables 3 at corresponding holes. This buffer 21 can thereby in an advantageous manner be moved up and down with the cable clip 20 and thus with the suspension cables 3. That means that no relative motion takes place between the suspension cables 3 and this buffer 21, thus no disturbing friction. At the same time, this buffer 21, which respectively surrounds the suspension cables 3, brings about that they are also held near the cable joints 15 at a constant distance and in a constant relationship to each other, and thus remain fixed in relation to each other even when lowered to the greatest possible length. The buffer 21 consequently has practically a double function, since it also contributes to the mutual stabilization of position of the two suspension cables 3 at their lower ends, but without preventing an equalization or an equalization motion in the area of the bolt on account of slightly different cable lengths.

Figure 4:
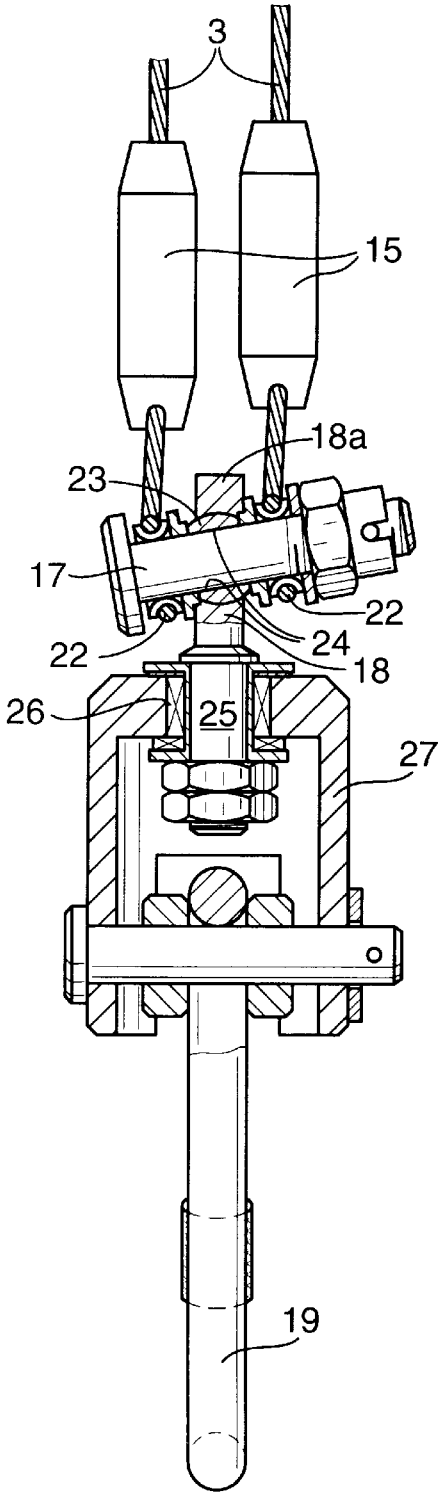
FIG. 4 is a view, enlarged in scale and partially in section, of the lower end of the two suspension cables and their connection with a load bearing element.
Figure 5:
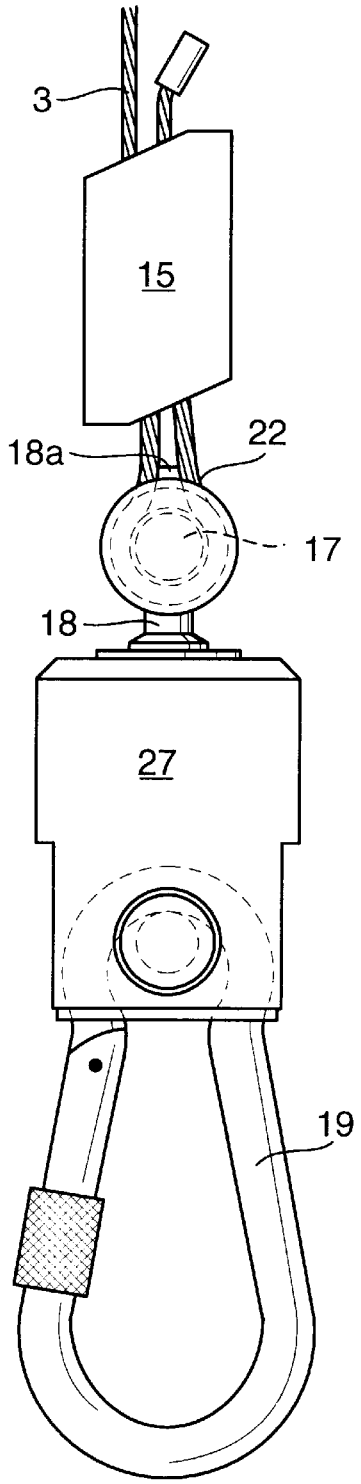
FIG. 5 is a side view of the arrangement in accordance with FIG. 4.

A modified embodiment with respect to the construction and attachment of the coupling element 18 is represented in FIGS. 4 and 5.

One recognizes chiefly in FIG. 4 that the coupling element 18 engages with a bearing projection 18*a* between the engagement positions of the two suspension cables 3 on the bearing bolt 17, wherein the engagement in this case is formed by means of cable slings 22 constructed from the cable joints 15 and projecting out of these. These cable slings 22 engage in accordance with FIG. 4 two opposed end areas of the bearing bolt 17, and are kept in this position at a distance from each other. FIG. 4 thereby makes it clear that the bearing bolt 17 projects on both sides in relation to the coupling element 18 and its bearing projection 18*a*, and can be pivoted around an axis running horizontal, transverse or at right angles to the bearing bolt 17 in the operating position, thus perpendicular to the drawing plane of FIG. 4. FIG. 4 illustrates a position tilted in this manner, which for example comes into being because the two suspension cables 3 and its cable joints 15 or slings 22 have somewhat differing height levels. Nonetheless, the coupling element 18 can hang down vertically, that is, such different height levels of the ends of the suspension cables 3 can be automatically compensated for. Furthermore, forces and loads are at the same time largely uniformly transferred and distributed to both suspension cables 3 by the suspension eye 19 situated below.

In the embodiment, the coupling element 18 and the bearing bolt 17 are connected with each other by means of a ball joint head 23 for this pivotability, wherein the ball joint head 23 has a boring 24 or opening for the passage of the bolt 17, and pivotably (or perhaps also rotatably) engages with its ball surface on a corresponding negative ball surface within the coupling element 18 or the bearing projection 18*a*. FIG. 4 makes it clear that in this manner the ball joint head 23 is correspondingly turned when tilting the bearing bolt 17, and the coupling element can consequently maintain its vertical position with its bearing projection 18*a*.

FIG. 4 depicts another beneficial configuration of this embodiment according to which namely the load-bearing element is rotatably mounted on the coupling element 18 around a vertical axis 25 in a corresponding axial-radial bearing 26. The rotation of a suspended load can thus be absorbed by this pivot bearing 26 and kept away from the suspension cables 3, so that these are not twisted with each other in the event of such a rotation. The user of a tool suspended by the device 1 need not during its handling make sure that he cancels rotations in one direction by corresponding counter rotations. Rather, he can execute rotations in one and the same direction as often as he wishes without the suspension cables 3 becoming twisted around each other and preventing further rotations in the same direction, and without their being able to be damaged by such entanglements.

One recognizes in this embodiment that the coupling element 18 carries the load-bearing body below the bearing bolt 17, in this case a load bearing bell 27, by means of the radial-axial bearing 26, so that this load bearing bell 27 can thus be rotated around the axis 25 in relation to the coupling element 18, whereby this axis 25 is connected in one piece with the coupling element 18 for the sake of simplicity. The suspension eye 19 is fastened to this load bearing element, which is configured as a load bearing bell 27 in this embodiment, in place of which, however, a load hook or the like could also be provided.

Of course, the suspension eye 19 or a load hook could also, however, itself as the load-bearing element be rotatably connected directly with the coupling element 18.

On account of the rotatability of the suspension eye 19 in relation to the coupling element 18 and the ends of the two suspension cables 3, the housing 4 of the device 1 can also be suspended in any desired manner, even of a different type than is represented in FIG. 1 and 3, for example likewise rotatably suspended without the resulting danger that the two suspension cables 3 can become entangled with each other. Consequently, allowance is made for at least two simultaneously operative suspension cables 3, and yet a most extensive free handling of a suspended load is made possible for the user, the forces of which nevertheless can be evenly or largely evenly distributed on the suspension cables 3.

Overall there results a weight equalizer or spring tension which can even carry relatively heavy loads, for example welding tongs, and thereby even allow working overhead, because by using several suspension cables 3, a considerably increased safety against cable break is available. Even if one of the suspension cables 3 should tear, the remaining suspension cable 3 can continue to hold the load, and the user receives a clear signal that he must change the suspension 3 or the device 1. Constant cable inspections during operation or pauses in operation, which frequently depend upon a considerable care of the inspector, can thus either be conducted at considerably greater intervals or be completely dispensed with. At the same time, expensive additional equipment with arrester cables are avoided.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A device (1) for equalizing the weight of a hanging load, said device being a spring tension weight equalizer, comprising a cable drum (2), at least two suspension cables (3) which can be unwound from the cable drum (2) against a spring force serving as weight equalizer, and a housing in which the cable drum is rotatably mounted, the housing having an opening (6) for the suspension cable (3) exiting downwardly, the cable drum (2) having an increasing diameter from a first end (7) where the suspension cables are finally rolled up to a second end (8) where the suspension cables (3) are finally let down, wherein the at least two suspension cables (3) are separate and substantially parallel and the cable drum (2) has a number of grooves (9) for accommodating the suspension cables (3), the grooves (9) being arranged parallel alongside each other and corresponding to the number of suspension cables (3) and being of respectively matching diameter, wherein the grooves (9) run helically on the cable drum (2) and are arranged respectively parallel to one another from their beginning to their end, and wherein each suspension cable (3) has a tear resistance corresponding to or exceeding the load to be assumed.

2. The device according to claim 1, wherein a cable guide (10) with spaced apart guide openings (11) for the individual suspension cables (3) is arranged below the opening (6), said cable guide (10) being fastened on a pendulum (12) which is pivotable about a rotation axis (13) of the cable drum (2).

3. The device according to claim 2, wherein the pendulum (12) comprises of two arms **(12*a*, 12*b* ) which are pivoted at a distance from each other on a common axis, and wherein the cable guide (10) has two spaced attachment points for the two arms (12*a*, 12*b*), between which the guide openings (11)** are arranged.

4. The device according to claim 3, wherein the common axis is a rotation axis (13) of the cable drum (2) and the two arms **(12*a*, 12*b*) are pivoted respectively on opposite ends of the axis (13)**.

5. The device according to claim 2, wherein the two arms **(12*a*, 12*b*) are fastened on end faces of the cable guide (10)**.

6. The device according to one of claim 2, wherein the cable guide (10) equalizes the pendulum movements and is pivotably mounted on the pendulum (12) or on the pendulum arms **(12*a*, 12*b*)**.

7. The device according to claim 2, wherein at least a part of the cable guide (10) having the guide openings (11) comprises an exchangeable material.

8. The device according to claim 2, wherein the cable guide (10) has a number of spaced apart guide openings (11) corresponding to the number of suspension cables (3), whose spacing is not less than a spacing distance between the grooves (9) of the cable drum (2), consequently a spacing between the suspension cables (3) on the cable drum (2).

9. Device according to claim 2, wherein one of the suspension cables (3) carries a cable clip (20) for restricting winding up motion of the suspension cables (3) on the cable drum (2), the cable clip (20) acting as a stop for an uppermost position of the suspension cable in relation to the cable guide (10).

10. The device according to claim 9, wherein a buffer (21) is arranged between the cable guide (10) and the cable clip (20).

11. The device according to claim 1, wherein cable joints (15) having one of holes (16) and cable slings (22) running transversely thereto are provided on respective free ends of the suspension cables (3) to be wound up by the cable drum (2), one of said holes (16) and cable slings (22) accommodating a common bearing pin (17) which is rotatable in relation to the cable joints (15), and a coupling element (18) with a load bearing body is fastened to the bearing pin (17).

12. The device according to claim 11, wherein the load bearing body is a suspension eye (19).

13. The device according to claim 11, wherein the coupling element (18) has a fork-shape and is rotatably and separably connected with the bearing pin (17) on both sides of the cable joints (15).

14. The device according to claim 11, wherein the coupling element (18) has a bearing projection **(18*a*) and engages between engagement positions of the suspension cables (3) on the bearing pin (17), and the bearing pin (17) projects out on both sides in relation to the coupling element (18) or the bearing projection (18***a*), and the coupling element is substantially freely rotatable about an axis running horizontally and transversely to the bearing pin (17) in an operating position.

15. The device according to claim 14, wherein the coupling element (18) its bearing projection (18*a*) and the bearing bolt are connected with one another by a ball joint head (23), wherein the ball joint head (23) has a boring (24) for passage of the bearing bolt (17) and pivotably engages with its ball surface on a negative ball surface inside the coupling element (18) or its bearing projection (18*a*).

16. The device according to claims 11, wherein the load bearing body is rotatably mounted on the coupling element (18) about a vertical axis (25).

17. The device according to claim 11, wherein the coupling element (18) carries the load bearing body beneath the bearing pin (17), and wherein the load bearing body is rotatably connected with the coupling element (18) around a vertical axis (25).

18. The device according to claim 17, wherein the load bearing body has attached thereto a suspension eye (19) or a load hook or is itself a suspension eye (19), a load hook, a fork or a bell (27).

19. The device according to claim 17, wherein the buffer (21) is penetrated at least by the suspension cable carrying the cable clip (20), and is movable up and down with the cable clip (20) and the suspension cable (3).

20. The device according to claim 19, wherein the buffer (21) is penetrated by all of the suspension cables (3).

* * * * *